US010577210B2

(12) United States Patent
Inoue

(10) Patent No.: US 10,577,210 B2
(45) Date of Patent: Mar. 3, 2020

(54) TRANSPORT DEVICE, PROCESSED PRODUCT PRODUCING METHOD, AND TRANSPORT CONTROL PROGRAM

(71) Applicant: SEIKO EPSON CORPORATION, Tokyo (JP)

(72) Inventor: Susumu Inoue, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 375 days.

(21) Appl. No.: 15/223,074

(22) Filed: Jul. 29, 2016

(65) Prior Publication Data

US 2017/0050814 A1 Feb. 23, 2017

(30) Foreign Application Priority Data

Aug. 18, 2015 (JP) ..... 2015-160836

(51) Int. Cl.
*B65H 20/36* (2006.01)
*B65H 23/192* (2006.01)

(52) U.S. Cl.
CPC ..... *B65H 20/36* (2013.01); *B65H 23/192* (2013.01); *B65H 2403/942* (2013.01); *B65H 2404/143* (2013.01); *B65H 2511/212* (2013.01); *B65H 2511/22* (2013.01); *B65H 2513/102* (2013.01); *B65H 2551/18* (2013.01); *B65H 2801/15* (2013.01)

(58) Field of Classification Search
CPC ..... B65H 20/36; B65H 23/192; B65H 2403/942; B65H 2404/143; B65H 2511/212; B65H 2511/22; B65H 2513/102; B65H 2551/18; B65H 2801/15
USPC ..... 700/122
See application file for complete search history.

(56) References Cited

U.S. PATENT DOCUMENTS

| | | | | |
|---|---|---|---|---|
| 3,733,018 | A | 5/1973 | Breimayer | |
| 4,988,982 | A * | 1/1991 | Rayner | G05B 19/409 341/22 |
| 5,115,320 | A * | 5/1992 | Ebihara | H04N 1/3873 358/296 |
| 6,450,433 | B1 * | 9/2002 | Fujii | G11B 15/48 242/334.1 |
| 2002/0001010 | A1 | 1/2002 | Abe | |
| 2004/0046887 | A1 | 3/2004 | Ikehata et al. | |
| 2004/0070659 | A1 | 4/2004 | Lee | |
| 2004/0227625 | A1 | 11/2004 | Joehl et al. | |

(Continued)

FOREIGN PATENT DOCUMENTS

| | | | |
|---|---|---|---|
| EP | 1477351 | A2 | 11/2004 |
| GB | 2050661 | A | 1/1981 |

(Continued)

*Primary Examiner* — James J Lee
*Assistant Examiner* — Michael W Choi
(74) *Attorney, Agent, or Firm* — Global IP Counselors, LLP

(57) ABSTRACT

A transport device includes a transport section, a processing section, a detector, and a transport controller. The transport section transports a sheet. The processing section performs processing on the sheet. The detector detects a movement of a pointing instrument on a detection surface of the detector itself. The transport controller allows the sheet to be transported by a distance corresponding to the movement of the pointing instrument, and in a direction corresponding to the movement of the pointing instrument.

17 Claims, 7 Drawing Sheets

(56) References Cited

U.S. PATENT DOCUMENTS

2005/0141944 A1 6/2005 Lee et al.
2005/0151770 A1 7/2005 Takeuchi
2009/0166417 A1 7/2009 Dammann et al.
2011/0261131 A1 10/2011 Eve et al.
2012/0050807 A1 3/2012 Noda et al.
2012/0074674 A1* 3/2012 Ohoka ..... B60R 11/0235 280/728.3
2012/0075193 A1* 3/2012 Marsden ..... G06F 3/023 345/168
2012/0091763 A1* 4/2012 Mihashi ..... B60J 7/0015 296/216.08
2013/0000812 A1 1/2013 Takemoto et al.
2013/0063514 A1 3/2013 Fukui
2013/0120313 A1* 5/2013 Sakuragi ..... G06F 3/0488 345/174
2013/0222305 A1 8/2013 Kanno
2013/0222307 A1 8/2013 Ozawa
2013/0257963 A1 10/2013 Yamamoto et al.
2014/0072358 A1 3/2014 Tomomatsu et al.
2015/0068408 A1 3/2015 Nagae et al.
2016/0119492 A1* 4/2016 Sasahara ..... H04N 1/00411 358/1.15
2016/0349849 A1* 12/2016 Kwon ..... G06F 3/011
2017/0109961 A1* 4/2017 Fridrich ..... A63F 5/045
2018/0046366 A1* 2/2018 Li ..... G06F 3/0488
2018/0147922 A1* 5/2018 Entenmann ..... B60J 7/0573

FOREIGN PATENT DOCUMENTS

JP 01-291235 A 11/1989
JP 02-130350 A 5/1990
JP 03-103912 A 4/1991
JP 07-025087 A 1/1995
JP 08-123114 A 5/1996
JP 2004-104594 A 4/2004
JP 2012-113645 A 6/2012
JP 2013-175090 A 9/2013
JP 2014-051022 A 3/2014
JP 2014-054795 A 3/2014

* cited by examiner

TRANSPORT DEVICE, PROCESSED PRODUCT PRODUCING METHOD, AND TRANSPORT CONTROL PROGRAM

CROSS REFERENCES TO RELATED APPLICATIONS

The entire disclosure of Japanese Patent Application No. 2015-160836, filed Aug. 18, 2015 is incorporated by reference herein.

BACKGROUND

1. Technical Field

The present invention relates to a transport device, a processed product producing method, and a transport control program.

2. Related Art

To date, printers provided with an operating means for feeding roll paper have been known. For example, in JP-A-8-123114, a printer that allows roll paper to, upon pressing down of a rewind button or a paper feed button by a user, be rewound or fed until the detection of an identification code recorded on the roll paper is disclosed. In addition to such a printer disclosed in JP-A-8-123114, a printer that allows roll paper to, when an operating means is continuously pressed during a period longer than or equal to a constant period of time, be continuously transported while the operating means is pressed, and to, when the operating means is briefly pressed, be transported by a constant distance has been known.

In such conventional configurations, however, there is room for improvement in providing users with a flexible and instinctive operating means for instructing a transport distance, a transport velocity, and/or a transport direction.

SUMMARY

An advantage of some aspects of the invention is that a transport device is provided which is easier to use than conventional transport devices.

According to one aspect of the invention, a transport device includes a transport section, a processing section, a detector, and a transport controller. The transport section transports a sheet. The processing section performs processing on the sheet. The detector detects a movement of a pointing instrument on a detection surface of the detector itself. The transport controller allows the sheet to be transported by a distance corresponding to the movement of the pointing instrument, and in a direction corresponding to the movement of the pointing instrument.

According to the one aspect of the invention, a user's operation of moving the pointing instrument on the detection surface enables the user to transport the sheet by a distance corresponding to the movement of the pointing instrument, and in a direction corresponding to the movement of the pointing instrument. With this configuration, therefore, users are able to flexibly allow such a transport device to transport a sheet through an instinctive operating means.

The movement of the pointing instrument may be defined by a direction in which the pointing instrument is moved on the detection surface and a distance by which the pointing instrument is moved on the detection means. These direction and distance may be a movement direction per unit time and a movement distance per unit time, or may be a trajectory and a total movement distance during a period from the contact of the pointing instrument with the detection surface until the release of the pointing instrument from the detection surface. Further, the movement of the pointing instrument may be defined by a direction in which the pointing instrument has been moved on the detection surface and a period of time (a contact duration time) from the contact of the pointing instrument with the detection surface until the release of the pointing instrument from the detection surface.

In the above transport device, the transport section may transport the sheet in a first direction, and the transport controller may allow the sheet to be transported by a distance proportional to a first-direction distance element constituting a distance of the movement of the pointing instrument on the detection surface, and corresponding to a distance element in a direction parallel to the first direction.

With this configuration, a user is able to, by moving the pointing instrument at least the first direction on the detection face, to allow the sheet to be moved by a distance proportional to a movement distance in the first direction.

Further, in the above transport device, the transport controller may allow the sheet to be transported at a velocity proportional to a velocity of the movement of the pointing instrument on the detection surface.

With this configuration, a user is able to instruct the transport velocity of the sheet by changing the velocity of the movement of the pointing instrument.

Further, in the above transport device, the detector may detect a configuration of the pointing instrument, and the transport controller may allow the sheet to be transported by a distance corresponding to the detected configuration of the pointing instrument.

With this configuration, a user is able to change the transport distance of the sheet by changing the configuration of the pointing instrument. In addition, it may be assumed that examples of the configuration of the pointing instrument include, but are not limited to, the number of the pointing instruments on the detection surface and a kind of the pointing instrument (for example, a human finger or a touch pen).

Further, in the above transport device, a display screen may be disposed so as to overlap the detection surface. Further, the transport controller may allow first scale marks indicating distances or second scale marks indicating distances and formed by enlarging the first scale marks to be displayed on the display screen. When the transport controller allows the sheet to be transported, on the basis of a second movement of the pointing instrument on the display screen on which the second scale marks are displayed, in the case where the second movement of the pointing instrument is the same as a first movement of the pointing instrument on the display screen on which the first scale marks are displayed, the transport controller may allow the sheet to be transported by a second distance corresponding to the second movement such that the second distance is shorter than a first distance corresponding to the first movement.

With this configuration, a user is able to create a situation that facilitates a minute adjustment of the transport distance of the sheet.

Further, in the above transport device, in response to a detection made by the detector and indicating a repetition of a specific movement of the pointing instrument on the detection surface, the transport controller may allow the sheet to be transported continuously after a release of the pointing instrument from the detection surface. Further, in response to a detection made by the detector and indicating stop of the pointing instrument on the detection surface, the transport controller may bring the transport of the sheet to stop.

With this configuration, a user is able to continue the transport of the sheet even after the release of the pointing instrument from the detection surface by repeating the specific movement of the pointing instrument. Further, with this configuration, a user is able to bring the transport of the sheet to stop by stopping the movement of the pointing instrument on the detection surface.

In addition, the invention encompasses a processed product producing method, a method for producing a processed product, a product resulting from processing on the sheet, transported in such a way as described above. Moreover, the invention encompasses a transport control program for allowing the above transport device to execute transport control. Further, the function of each of constituent elements set forth in appended claims is realized by hardware resources that allow the relevant function to be specified by hardware components themselves, hardware resources that allow the relevant function to be specified by programs, or a combination of these two kinds of hardware resources. Further, the function of each of the constituent elements is not limited to a function realized by hardware resources that are physically independent of one another.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention will be described referring to the accompanying drawings. It is to be noted that, in the figures, constituent elements associated with one another are denoted by the same reference sign, and duplicated description thereof will be omitted.

1. First Embodiment

1.1 Configuration

Figure 1:
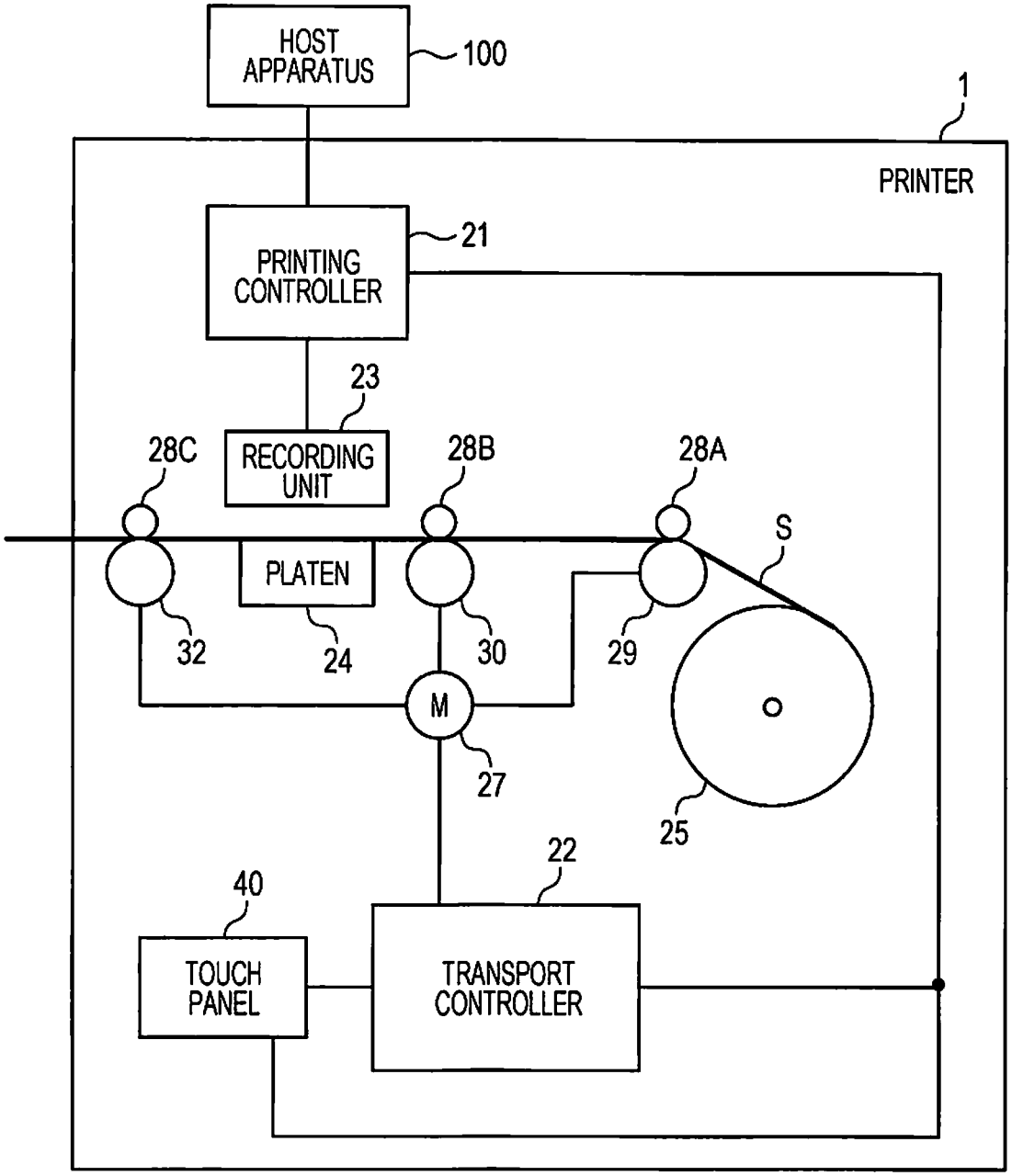
FIG. 1 is a block diagram illustrating a schematic configuration of a printer serving as a transport device according to an embodiment of the invention.

FIG. 1 is a block diagram illustrating a schematic configuration of a printer 1, a printer serving as a transport device according to an embodiment of the invention. The printer 1 has two operation modes, one being a printing mode in which the printing 1 executes printing in accordance with an instruction from a host apparatus 100, the other one being a transport mode in which the printer 1 allows a sheet S to, in accordance with an instruction from a user, be transported in a normal direction or a reverse direction to perform an adjust of a printing start position, an adjustment of blank spaces, or any other like adjustment. During a printing period, that is, for example, a period from the reception of the printing instruction from the host apparatus 100 until the completion of a printing job associated with the printing instruction, the printer 1 operates in the printing mode. Further, during a period other than the printing period, the printer 1 operates in the transport mode.

Upon reception of a printing instruction from the host apparatus 100, in accordance with the printing instruction, a printing controller 21 allows a recording unit 23 to execute printing and allows a transport controller 22 to transport the sheet S. The printing controller 21 includes a CPU, a RAM, a ROM, a nonvolatile memory, a communication I/F circuit, and any other component, and allows the CPU to execute a printing control program recorded in the ROM or the nonvolatile memory using the RAM, so as to execute printing processing. The recording unit 23 discharges ink droplets onto the sheet S, which is moved between the recording unit 23 and a platen 24 by the transport controller 22, on the basis of signals output from the printing controller 21, so as to form an image on the sheet S. The printing controller 21 and the recording unit 23 correspond to the "processing section".

Further, the printer 1 includes a touch panel 40. The touch panel 40 in this embodiment includes a display and a touch detection panel. Various images are displayed on the display under the control of the transport controller 22. The touch detection panel is disposed on the display so as to overlap the display. At present, there are various types of touch panels, and any appropriate type of touch panel among them may be employed as the touch panel 40. In the transport mode, a user is able to input an instruction in relation to a transport direction, a transport distance, or any other like setting item for the transport of the sheet S while shifting his or her finger on a display screen (i.e., a detection surface) of the touch panel 40. The touch panel 40 corresponds to the "detector". In addition to such a human finger, any pointing instrument detectable by the detection surface, such as a touch pen, may be employed as the pointing instrument.

In the printing mode, the transport controller 22 controls the transport movement of the sheet S on the basis of an instruction from the printing controller 21. Further, in the transport mode, in response to a transport instruction input by a user via the touch panel 40, the transport controller 22 controls the transport movement of the sheet S. The transport controller 22 is constituted by a CPU, a ROM, a RAM, a nonvolatile memory, and any other component. The transport controller 22 allows the CPU to execute a transport control program recorded in the ROM or the nonvolatile memory using the RAM as needed, so as to realize the transport movement.

The printer 1 includes a paper feed roller 29, a transport roller 30, a paper ejection roller 32, a motor 27, and driven rollers 28A, 28B, and 28C. These components serve as the "transport section", and the motor 27 drives the paper feed roller 29, the transport roller 30, and the paper ejection roller 32. The transport controller 22 provides a rotation direction, a rotation angle, and a rotation velocity to the motor 27, and then, allows the motor 27 to rotate. The driven roller 28A, the driven roller 28B, and the driven roller 28C are respectively disposed at a position opposite the paper feed roller 29 with the sheet S therebetween, a position opposite the transport roller 30 with the sheet S therebetween, and a position opposite the paper ejection roller 32 with the sheet S therebetween. Further, each of the driven rollers 28A, 28B, and 28C pushes and presses the sheet S integrally with a corresponding one of the paired rollers so that the sheet S is moved by a frictional force between the sheet S and each of the rollers.

The transport controller 22 controls the transport direction of the sheet S by controlling the rotation direction of the motor 27.

In this specification, a transport in a direction in which the sheet S having been fed from a roll paper 25 is transported toward the recording unit 23 side is called a positive-direction transport (a positive transport); while a transport in a direction in which the sheet S is transported from the recording unit 23 side toward the roll paper 25 side is called a negative-direction transport or a reverse-direction transport (a negative transport or a reverse transport). Further, the transport controller 22 controls the transport velocity of the sheet S by controlling the rotation velocity of the motor 27. Further, the transport controller 22 controls the transport distance of the sheet S by controlling the rotation angle of the motor 27. In addition, when executing the reverse transport, the transport controller 22 may perform control so as to allow the paper feed roller 29 to transport the sheet S in the reverse direction, and allow a motor (not illustrated) to rotate a shaft penetrating the core of the roll paper 25 so as to allow the sheet S to be wound again.

1.2 Transport Control Corresponding to Operation

Next, operations onto the touch panel 40 and transport control corresponding to each of the operations will be described step by step with reference to FIGS. 2A to 6D. For the convenience of description, an upper-left vertex of a rectangular-shaped display screen 40*a* of the touch panel 40 is defined as an original point O, and an x-axis and a y-axis that are perpendicular to each other and allow their respective original points to be placed on the original point O are defined. The following description will be made under the assumption that a y-axis positive direction corresponds to a downward direction in the display screen 40*a*, and an x-axis positive direction corresponds to a rightward direction in the display screen 40*a*. The touch panel 40 is attached to the chassis of the printer 1 at the downstream side of the positive-direction transport of the sheet S in an attitude that allows the width direction (the x-axis) of the display screen 40*a* to be perpendicular to the direction of the transport of the sheet S.

In addition, in this specification, a swipe operation is defined as an operation that moves a finger in a state in which the finger is kept in contact with the display screen and that allows a duration time from the start of the contact until the end of the contact (i.e., a contact duration time) to be shorter than a predetermined first threshold time. Further, a drag operation is defined as an operation that moves a finger in a state in which the finger is kept in contact with the display screen and that allows a contact duration time to be longer than or equal to the first threshold time. Further, a touch and hold operation is defined as an operation that allows a finger to remain in contact with the same position on the display screen during a period of time longer than or equal to a predetermined second threshold time. The first threshold time and the second threshold time may be the same.

Figure 2A:
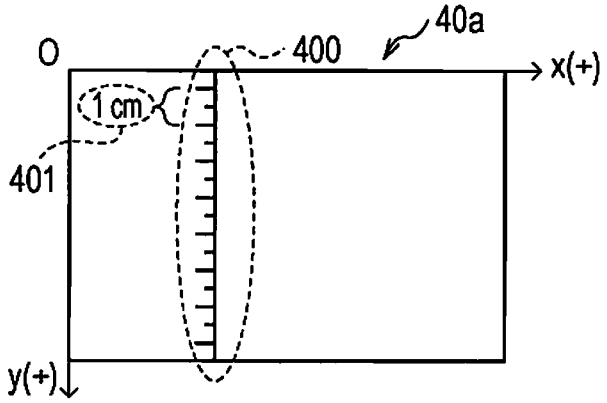
FIGS. 2A to 2C are diagrams illustrating display contents and an operation in relation to the printer.

In the transport mode, scale marks 400 and a numerical value 400 are displayed, as shown in FIG. 2A. The numerical value 400 indicates the length of each of the intervals of the scale marks 400. The scale marks 400 and the numerical value 401 indicate the relationship between a length on the display screen 40*a* and an actual length corresponding thereto. When, in a state in which the sheet S is stopped, a user performs the swipe operation once with his or her single finger, the sheet S is transported by a predetermined constant distance, and in a direction corresponding to the swipe operation. Specifically, for example, when, as shown in FIG. 2B, a user performs the swipe operation once with his or her single finger in the y-axis positive direction, the transport controller 22 determines that one swipe operation in the y-axis positive direction has been performed, on the basis of the movement direction of the finger and the situation in which the contact duration time of the contact with the display screen 4*a* is shorter than the first threshold time, and then, allows the sheet S to be transported by a first distance L1 in the positive direction. While transporting the sheet S by the first distance L1, the transport controller 22 displays a numerical value 402 on the display screen 40*a*, as shown FIG. 2C. This numerical value 402 indicates the distance of the transport having been triggered by this swipe operation (i.e., the first distance L1). Further, an arrow 403 is also displayed and this arrow 403 indicates the direction of the transport. The length of the arrow 403 in a direction parallel to the y-axis corresponds to the transport velocity.

When having transported the sheet S by the first distance L1, the transport controller 22 terminates the display of the numerical value 402. As a result, the content of the display on the display screen 40*a* returns to the state shown in FIG. 2A. In addition, the swipe operation and the drag operation described below may not be performed in a direction strictly parallel to the y-axis. That is, the direction, in which the swipe operation and the drag operation are performed, may be displaced toward a direction parallel to the x-axis to a certain degree. In any case, the transport controller 22 uses the direction and the distance of a y-axis element of a vector representing the movement of the finger on the display screen 40*a*. The direction parallel to the y-axis corresponds to the "first direction".

Figure 2D:
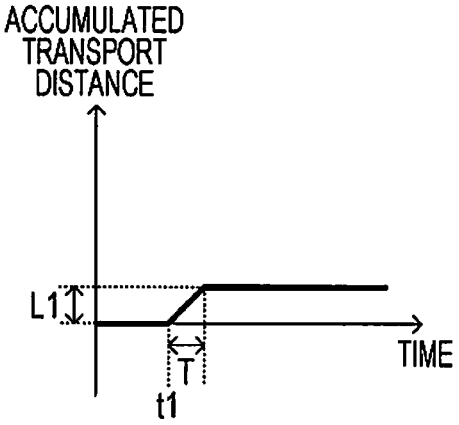
FIG. 2D is a graph illustrating transport movements in relation to the printer.
Figure 2B:
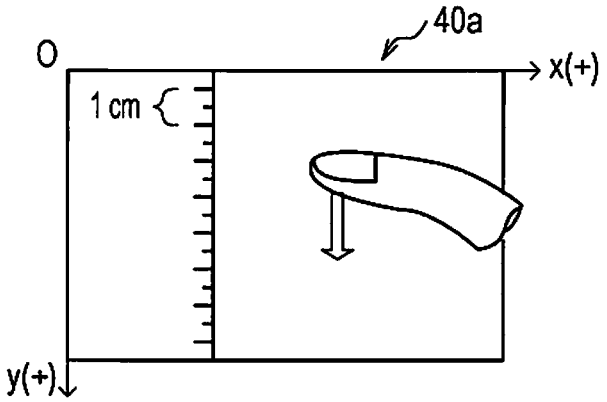
Figure 2C:
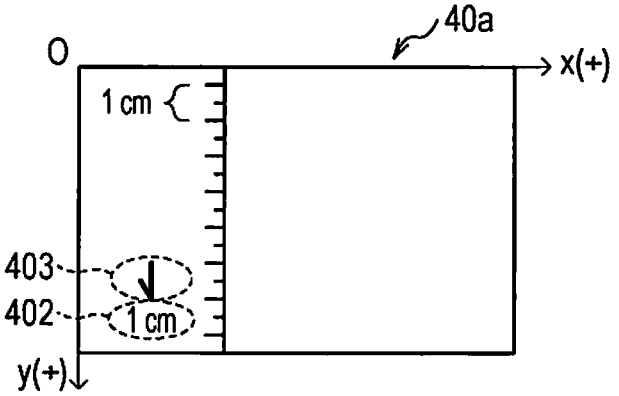

FIG. 2D illustrates a graph representing a relationship between an accumulated transport distance and an elapse time from a certain time point which is before the execution of this swipe operation and at which the sheet S is in a stop state. FIG. 2D indicates that, at a time point immediately before a time point t1, it has been determined that a wipe operation has been executed, and thereafter, the sheet S is transported by the first distance L1. In this case, FIG. 2D also indicates that the transport velocity is equal to L1/T.

Subsequently, a continuous swipe operation will be described. When a user continuously performs a swipe operation with his or her single finger in a state in which the sheet is stopped, the transport of the sheet S enters a continuous transport state in which the transport of the sheet S is continuously executed even after the user has released his or her finger from the display screen to terminate the continuous swipe operation. Further, in the continuous transport state, the transport is executed at a velocity higher than the velocity (L1/T), at which, in response to one swipe operation, the sheet S is transported by the first distance L1. In this embodiment, the swipe operation corresponds to the "specific movement".

Figure 3A:
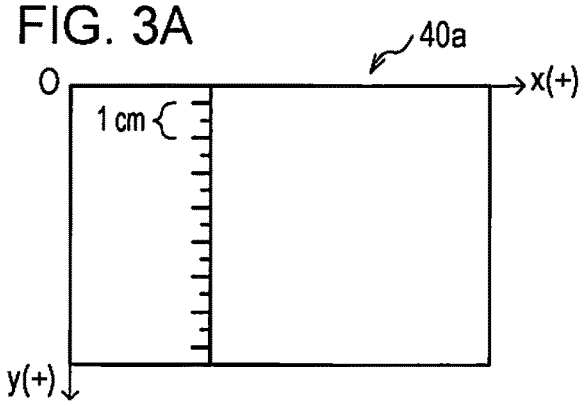
FIGS. 3A to 3D are diagrams illustrating display contents and operations in relation to the printer.
Figure 3B:
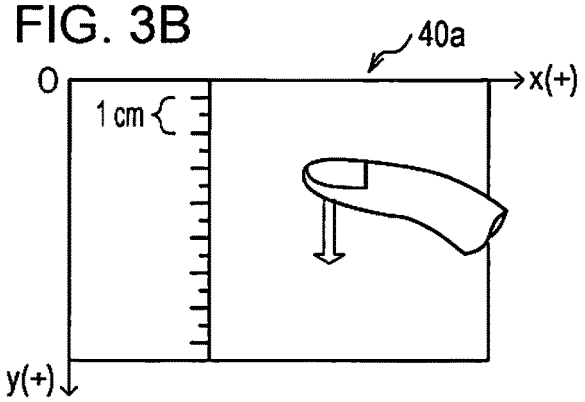

Specifically, for example, in a state in which the sheet S is stopped (i.e., in the case where the display screen 40*a* is in a state illustrated in FIG. 3A), when, as shown in FIG. 3B, a user performs one swipe operation with his or her single finger in the y-axis positive direction, the transport controller 22 determines that one swipe operation in the y-axis positive direction has been performed, on the basis of the contact duration time of the contact with the display screen 40*a* and the movement direction of the finger, and then, allows the sheet S to be transported by the first distance L1 in the positive direction (in this case, the transport velocity being equal to L1/T). While transporting the sheet S by the first distance L1, the transport controller 22 allows the numerical value 402 and the arrow 403 to be displayed on the display screen 40*a*, as shown FIG. 3C. The numerical value 402 indicates the distance of the transport having been triggered by this swipe operation (i.e., the first distance L1). The arrow 403 indicates the transport direction and the transport velocity of the transport, having been triggered by this swipe operation. The description having been made so far is the same as that of the transport movement corresponding to one swipe operation, having been described using FIG. 2.

Figure 3C:
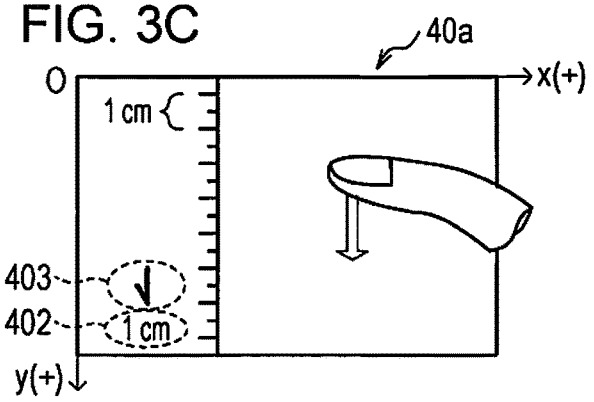
Figure 3D:
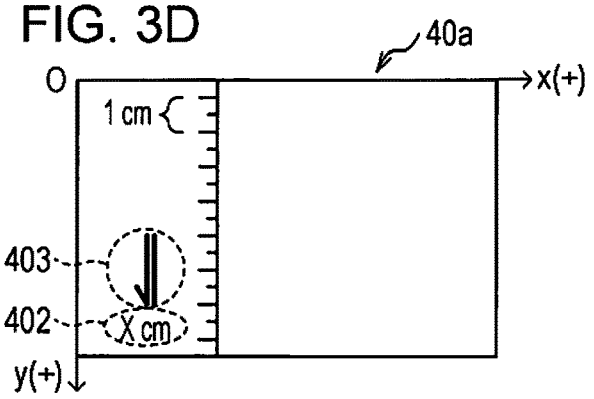

During a period when the sheet S is transported by the first distance L1, when, as shown in FIG. 3C, the user performs the swipe operation again with his or her single finger in the y-axis positive direction, the transport controller 22 determines that a second swipe operation has been performed (that is, a continuous swipe operation has been performed) in the y-axis positive direction, on the basis of the contact duration time of the contact with the display screen 40*a* and the movement direction of the finger, and then, continuously allows the sheet S to be transported by a second distance L2. In this case, a distance per unit time T in relation to the second distance L2 is longer than a distance per unit time in relation to the first distance L1. That is, the transport controller 22 allows the sheet S to be transported at a velocity higher than the transport velocity corresponding to the single swipe operation. In the continuous transport state, as shown in FIG. 3D, the transport controller 22 allows a numerical value 402 to be displayed. The numerical value 402 indicates an accumulated transport distance resulting from accumulating distances during a period from a certain time point in a sheet stop state, and is incremented at, for example, predetermined time intervals. Further, in order to indicate that the sheet S is being transported at a velocity higher than the velocity of the transport corresponding to the single swipe operation, an arrow indicating the direction of the transport is displayed in a state in which the length of the arrow itself is made longer. Further, in order to indicate that the transport of the sheet S is in the continuous transport state, the arrow is displayed in a form that is different from the form of the arrow displayed in the case of the single swipe operation, and that allows the arrow itself to be represented in, for example, a double line.

Figure 3E:
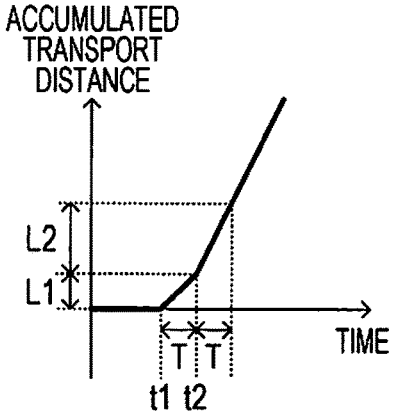
FIG. 3E is a graph illustrating transport movements in relation to the printer.

FIG. 3E illustrates a graph representing a relationship between an accumulated transport distance and an elapse time in the case where a certain time point which is before the execution of this swipe operation and at which the sheet S is in a stop state is placed as a reference point. FIG. 3E indicates that, in the case where, at a time point immediately before the time point t1, it has been determined that a wipe operation has been performed, and at a time point immediately before a time point t2, at which the transport corresponding to the first transport distance is to be completed, it has been determined that a continuous wipe operation has been performed, a transport velocity after the time point t2 is higher than the transport velocity between the time point t1 and the time point t2. In addition, the transport velocity may be stepwise increased every time the number of continuous transport movements during a sheet transport is incremented.

Figure 4A:
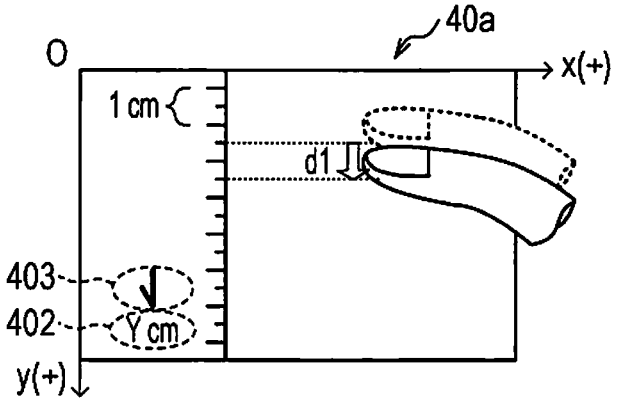
FIGS. 4A, 4C, and 4E are diagrams illustrating display contents and operations in relation to the printer.
Figure 4B:
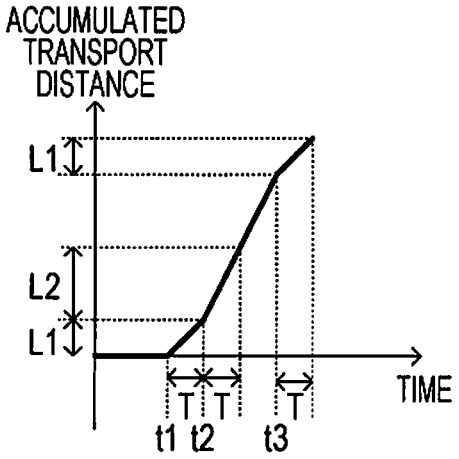
FIGS. 4B, 4D, and 4F are graphs illustrating transport movements in relation to the printer.

Next, a drag operation during a continuous transport will be described with reference to FIGS. 4A to 4E. For example, in the case where the sheet S is in a positive-direction continuous transport state, when, as shown in FIG. 4A, a user performs a drag operation with his or her single finger in the y-axis positive direction on the display screen 40*a*, the transport controller 22 allows the sheet S to be transported in the positive direction at a velocity proportional to the velocity of the first-direction element of the drag operation. The transport controller 22 determines that a drag operation in the y-axis positive direction has been performed, on the basis of the direction of the movement of the finger and the situation in which the contact duration time of the contact of the finger is longer than or equal to the first threshold time. Further, during the drag operation, the transport controller 22 detects, for each unit time T, a movement distance of the movement of the finger in a direction parallel to the y-axis. A specific example will be described using FIG. 4B. When having determined that a drag operation in the y-axis positive direction has been performed, at a time point, for example, immediately before the time point t3, in a state in which the continuous transport having been started at the time point t2 is executed, the transport controller 22 allows the sheet S to be transported in the positive direction at a velocity proportional to the velocity of the drag operation, after the time point t3. For example, when having detected that a drag operation in the y-axis positive direction has been performed by a distance dl on the display screen during the unit time T, the transport controller 22 allows the sheet S to be transported at a velocity L1/T after the time point t3. In this case, the distance dl corresponds to an actual distance L1. In addition, in the above case and a case described below, with respect to the drag operation, a movement distance in the direction parallel to the y-axis on the display screen 40*a* and a transport distance of the sheet S have a proportional relationship therebetween. The proportional coefficient can be made variable in accordance with a user's operation, but it is preferable that the proportional coefficient is made equal to "1". That is, the situation in which the movement distance in the direction parallel to the y-axis on the display screen 40*a* and the transport distance of the sheet S are made equal to each other is preferable, because this situation enables a user to instinctively operate.

Figure 4C:
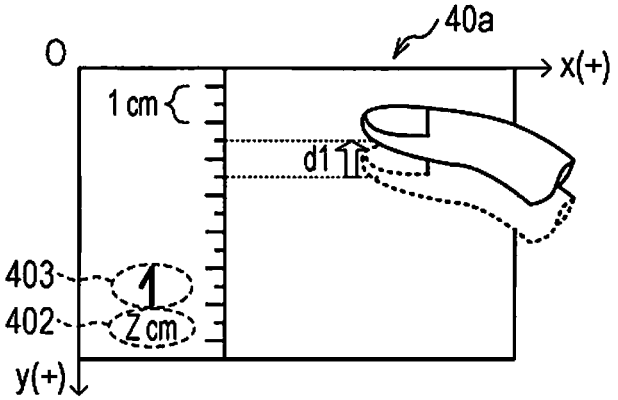
Figure 4D:
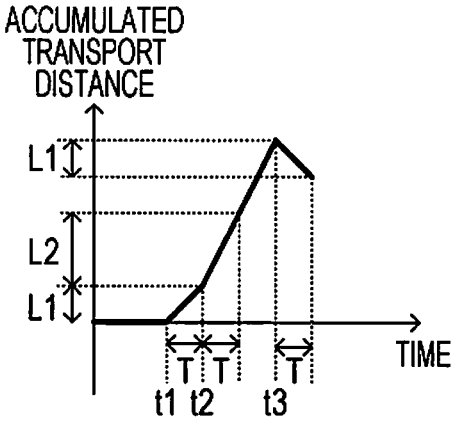

Further, for example, in the case where the sheet S is in the positive-direction continuous transport state, when, as shown in FIG. 4C, a user performs a drag operation with his or her single finger in the y-axis negative direction on the display screen 40*a*, the transport controller 22 allows the sheet S to be transported at a velocity proportional to the velocity of the first-direction element of the drag operation. A specific example will be described using FIG. 4D. When having determined that a drag operation in the y-axis negative direction has been performed, at a time point, for example, immediately before the time point t3, in a state in which the continuous transport having been started at the time point t2 is executed, the transport controller 22 allows the sheet S to be transported in the negative direction at a velocity proportional to the velocity of the drag operation, after the time point t3. For example, when having detected that the drag operation has been performed by a distance dl on the display screen in the y-axis negative direction during the unit time T, since the distance dl corresponds to an actual distance L1, the transport controller 22 allows the sheet S to be transported at a velocity L1/T in the negative direction, after the time point t3. In this way, a user is able to, through the execution of a drag operation during a continuous transport, allow the sheet S to be transported at a transport velocity corresponding to the velocity of the drag operation in a transport direction corresponding to the direction of the drag operation. In addition, an operation of releasing the finger from the display screen 40*a* to terminate the drag operation may be allowed to release the continuous transport state so as to bring the transport to stop.

Figure 4E:
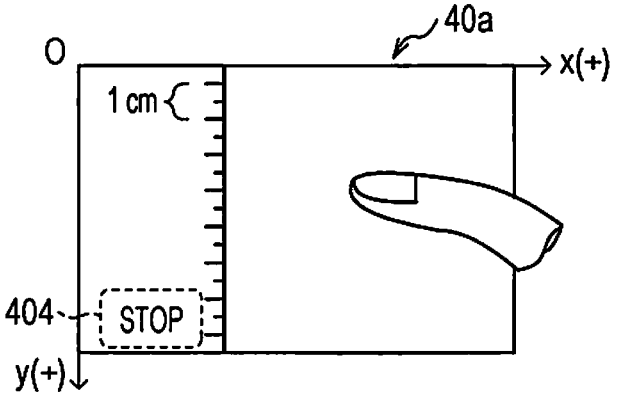
Figure 4F:
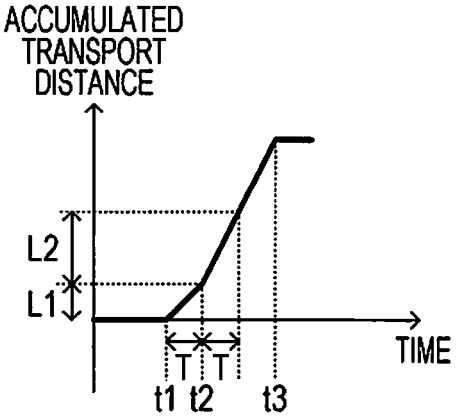

Further, in the case where the sheet S is in the continuous transport state, for example, when, as shown in FIG. 4E, a user performs a touch and hold operation with his or her single finger on the display screen, the continuous transport state is released and the transport of the sheet S is brought to stop. The graph in FIG. 4F indicates that, when it has been determined that a touch and hold operation has been performed, at a time point immediately before the time point t3 in a state in which the continuous transport having been started at the time point t2 is executed, the transport of the sheet S is brought to stop. The transport controller 22 displays characters 404 on the display screen 40*a*. The characters 404 indicate that the transport of the sheet S has been brought to stop.

In addition, the execution of the sheet transport corresponding to the direction and the velocity of the drag operation is not limited to such an execution in the state in which the sheet S is in the continuous transport state. For example, even when the sheet S is in a stop state, the sheet S may be transported at a velocity corresponding to the velocity of the drag operation, and in a direction corresponding to the direction of the drag operation.

Figure 5A:
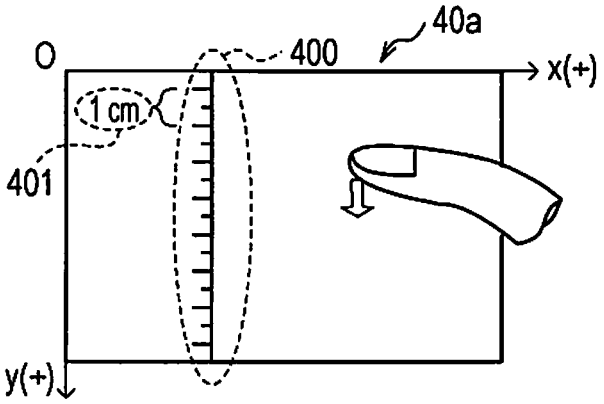
FIGS. 5A and 5B are diagrams illustrating display contents and operations in relation to the printer.
Figure 5C:
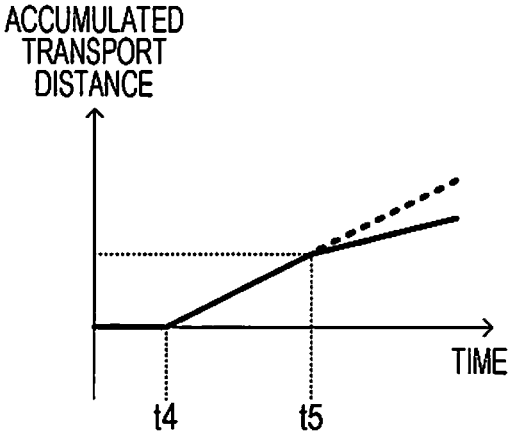
FIG. 5C is a graph illustrating transport movements in relation to the printer.
Figure 5B:
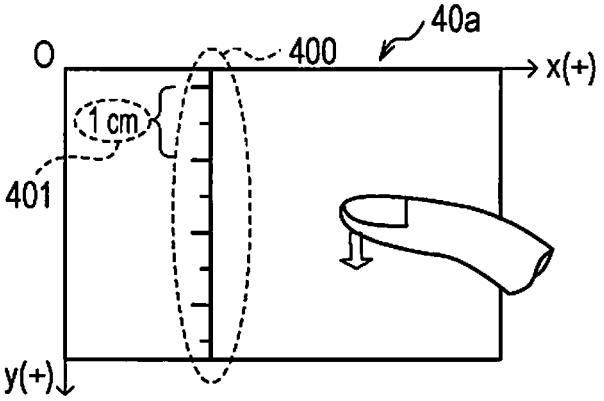

Further, in the case where a state in which a drag velocity in the direction parallel to the y-axis is lower than a predetermined first velocity is continued during a period of time longer than or equal to a predetermined first period of time, the transport controller may switch a current transport velocity to a velocity lower than the current transport velocity. A specific example will be described using FIGS. 5A to 5C. For example, it is supposed that a drag operation in the y-axis positive direction is started in a state in which the sheet S is stopped. Scale marks 400 and a numerical value 401 are displayed on the display screen 40*a*. The numerical value 401 indicates the length of each of the intervals the scale marks 400. When having determined immediately before a time point t4 that the drag operation has been performed, the transport controller 22 allows the sheet S to be transported at a velocity proportional to the velocity of the drag operation, after the time point t4. When having determined that a drag operation having a velocity lower than the first velocity has been continued during a period of time longer than the first period of time, at a time point after the time point t4 and immediately before a time point t5, the transport controller 22 allows, as shown in FIG. 5B, the scale marks 400 to be displayed in a state in which the scale marks 400 are enlarged to, for example, twice the scale marks 400 shown in FIG. 5A, after the time point t5. The scale marks 400 shown in FIG. 5A correspond to the "first scale marks", and the scale marks 400 shown in FIG. 5B correspond to the "second scale marks". In a state in which it has been determined immediately before the time point t5 that a state in which the velocity of the y-axis element of the drag operation is lower than the first velocity has been continued during a period of time longer than the first period of time, and the enlarged scale marks 400, shown in FIG. 5B, have been displayed after the time point t5, even when a drag operation is performed at the same velocity as the velocity as of before the time point t4, the transport velocity of the sheet S is made half the transport velocity of the sheet S before the time point t4. Thus, as a result, during an identical period of time, a transport distance in the above case is half a transport distance before the time point t4. This configuration facilitates a user's fine adjustment of the transport distance of the sheet S.

Figure 6A:
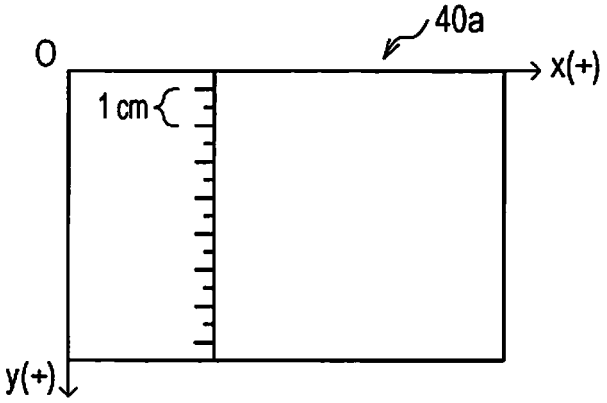
FIGS. 6A to 6C are diagrams illustrating display contents and operations in relation to the printer.
Figure 6D:
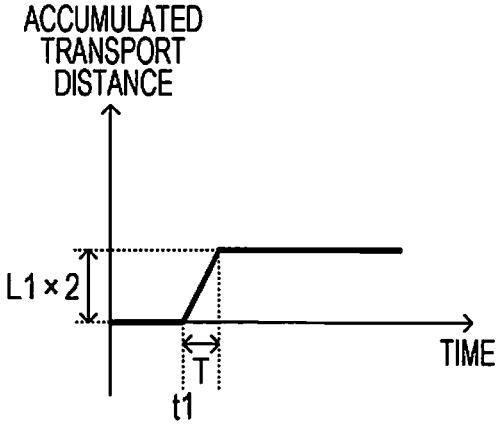
FIG. 6D is a graph illustrating transport movements in relation to the printer.
Figure 6B:
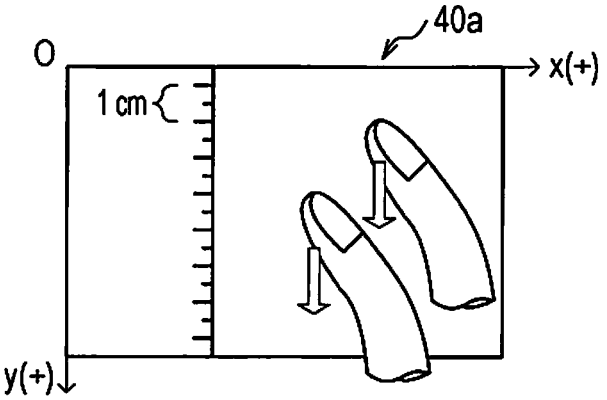
Figure 6C:
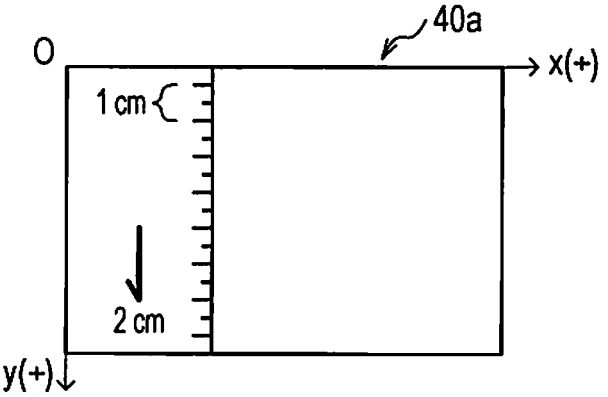

Further, when, as shown in FIGS. 6A to 6C, a swipe operation is performed in the y-axis positive direction simultaneously using, for example, two fingers, the sheet S may be allowed to be transported at a velocity higher than a sheet transport velocity corresponding to a swipe operation using one finger. For example, as shown in FIG. 6D, the sheet S may be allowed to be transported by a distance twice the distance in the case of a swipe operation using one finger (see FIG. 2D) at a velocity twice the transport velocity in the case of the swipe operation using one finger.

As described above, a user is able to input transport instructions into the printer 1 in an instinctive and flexible manner by moving his or her finger on the display screen 40*a* of the touch panel 40. Further, a user is able to allow the printer 1 to execute printing in accordance with a printing instruction from the host apparatus 100 after having adjusted the position of the sheet S, and thus, this configuration enables a user to obtain a printed product (corresponding to the "processed product") having been subjected to printing on a desired position of roll paper.

2. Other Embodiments

It is to be noted that the technical scope of the invention is not limited to the aforementioned embodiment and, naturally, various modifications may be made on the aforementioned embodiment within the scope not departing from the gist of the invention. For example, the transport device according to one aspect of the invention may be applied to a scanner (an image reading device). In the case where the transport device according to one aspect of the invention is applied to the scanner, image data obtained by reading an original document corresponds to the "processed product". For example, a receipt or a film may be assumed as the original document. Further, the sheet is not limited to the roll paper, but may be cut paper, fanfold paper, or any other like paper.

Further, for example, the transport device according to one aspect of the invention may include a touch panel having no display function (for example, a touchpad or a track pad), and the sheet transport may be executed so as to allow the direction and the distance of the sheet transport to correspond to the movement of a pointing instrument on a detection surface of the relevant touch panel.

Further, in the aforementioned embodiment, an example in which, when a drag operation has been performed in the y-axis negative direction when a sheet is in a positive-direction continuous transport state, the sheet is allowed to be transported in the reverse direction has been described, but when a drag operation has been performed in the y-axis negative direction when a sheet is in the positive-direction continuous transport state, the transport of the sheet may be controlled such that the transport direction remains the positive direction and the transport velocity is reduced. When a drag operation in a direction reverse to a current transport direction has been performed when a sheet is in a continuous transport state, the velocity of the continuous transport may be reduced so as to correspond to the drag velocity.

Figure 7:
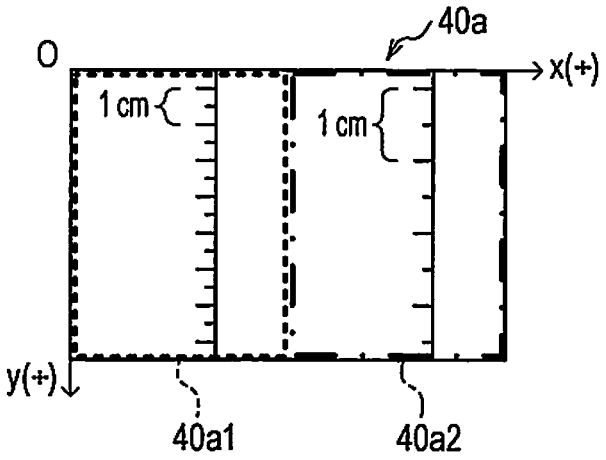
FIG. 7 is a diagram illustrating a display content in another embodiment of the invention.

In addition, for example, as shown in FIG. 7, the display screen 40*a* may be divided into two regions 40*a*1 and 40*a*2. Further, in the region 40*a*1, non-enlarged scale marks similar to those shown in FIG. 5A may be displayed, and in the region 40*a*2, enlarged scale marks similar to those shown in FIG. 5B may be displayed. Further, when a drag operation is performed in a direction parallel to the y-axis within the region 40*a*2, a sheet may be transported by a shorter distance at a lower velocity, as compared with a distance and a velocity in a case where a similar drag operation has been performed within the region 40*a*1.

What is claimed is:

1. A transport device comprising:

a transport section including a motor and at least one roller configured to be rotated by the motor to transport an object;

a processing section configured to perform processing on the object;

a detector configured to detect a movement of a pointing instrument on a detection surface of the detector itself;

a transport controller configured to allow the object to be transported by a transport distance corresponding to the movement of the pointing instrument, and in a direction corresponding to the movement of the pointing instrument, the transport distance being variable according to a movement distance of the pointing instrument; and a display screen disposed so as to overlap the detection surface, wherein the transport controller is configured to display first scale marks indicating distances or second scale marks indicating distances and formed by enlarging the first scale marks on the display screen, and the transport controller is configured to allow the object to be transported by a first transport distance in a first case where the pointing instrument moves in a first direction by a first distance and the first scale marks are displayed on the display screen, and allows the object to be transported by a second transport distance, which is shorter than the first transport distance, in a second case where the pointing instrument moves in the first direction by the first distance and the second scale marks are displayed on the display screen, when positions of the object and the pointing instrument before the pointing instrument moves are the same for the first case and the second case, wherein the second case is a state in which a drag velocity during the first case is lower than a predetermined velocity for a period of time longer than or equal to a predetermined period of time.

2. The transport device according to claim 1, wherein the transport controller allows the object to be transported by a distance proportional to a first-direction distance element constituting a distance of the movement of the pointing instrument on the detection surface, and corresponding to a distance element in a direction parallel to the first direction.

3. The transport device according to claim 2, wherein the transport controller allows the object to be transported at a velocity proportional to a first-direction velocity element constituting a velocity of the movement of the pointing instrument on the detection surface, and corresponding to a velocity element in a direction parallel to the first direction.

4. The transport device according to claim 2, wherein the transport controller allows the object to be transported at a first transport velocity when the first-direction velocity element of the velocity of the movement of the pointing instrument is a first movement velocity, and allows the object to be transported at a velocity higher than the first transport velocity when the first-direction velocity element of the velocity of the movement of the pointing instrument is a velocity higher than the first movement velocity.

5. The transport device according to claim 1, wherein the detector detects a number of fingers of a user on the detection surface of the detector as a configuration of the pointing instrument, and the transport controller allows the object to be transported by a distance corresponding to the detected configuration of the pointing instrument.

6. The transport device according to claim 5, wherein the transport controller allows the object to be transported at a first velocity when the number of the fingers on the detection surface is one, and allows the object to be transported at a second velocity different from the first velocity when the number of the fingers on the detection surface is two.

7. The transport device according to claim 6, wherein the second velocity is higher than the first velocity.

8. The transport device according to claim 1, wherein in response to a detection made by the detector and indicating a repetition of a specific movement of the pointing instrument on the detection surface, the transport controller allows the object to be transported continuously after a release of the pointing instrument from the detection surface, and in response to a detection made by the detector and indicating stop of the pointing device on the detection surface, the transport controller brings the object to stop.

9. The transport device according to claim 1, wherein the processing section is configured to perform printing processing or scanning processing as the processing on the object.

10. The transport device according to claim 1, wherein the transport controller allows the object to be transported by a fifth transport distance in a fifth case where the pointing instrument moves in the first direction by a fifth movement distance, and allows the object to be transported by a sixth transport distance, which is longer than the fifth transport distance, in a sixth case where the pointing instrument moves in the first direction by a sixth movement distance, which is longer than the fifth movement distance, when positions of the object and the pointing instrument before the pointing instrument moves are the same for the fifth case and the sixth case.

11. The transport device according to claim 1, wherein the detector detects whether a number of fingers of a user on the detection surface of the detector is one or two, and the transport controller allows the object to be transported by a third transport distance in a third case where the pointing instrument moves in the first direction by a third distance and the number of the fingers on the detection surface is one, and allows the object to be transported by a fourth transport distance, which is longer than the third transport distance, in a fourth case where the pointing instrument moves in the first direction by the third distance and the number of the fingers on the detection surface is two, when positions of the object and the pointing instrument before the pointing instrument moves are the same for the third case and the fourth case.

12. The transport device according to claim 1, further comprising a platen on which the object is placed, wherein the transport section is configured to transport the object placed between the processing section and the platen.

13. The transport device according to claim 12, wherein the processing section is configured to perform printing processing or scanning processing as the processing on the object placed on the platen.

14. The transport device according to claim 1, wherein the display screen is configured to simultaneously display the first scale marks and the second scale marks.

15. The transport device according to claim 1, wherein the display screen is configured to display information indicative of the transport distance and a direction in which the object has been transported as a result of the movement of the pointing instrument.

16. A processed product producing method using a transport device including a transport section including a motor and at least one roller configured to be rotated by the motor to transport an object, a processing section configured to perform processing on the object, a detector configured to detect a movement of a pointing instrument on a detection surface of the detector itself, and a transport controller configured to allow the object to be transported by a distance corresponding to the movement of the pointing instrument, and in a direction corresponding to the movement of the pointing instrument, the method comprising the successive steps of:

detecting, by the detector, a movement of the pointing instrument on the detection surface of the detector;

allowing, by the transport controller, the transport section to transport the object by a transport distance corresponding to the detected movement of the pointing instrument, and in a direction corresponding to the detected movement of the pointing instrument, the transport distance being variable according to a movement distance of the pointing instrument;

displaying first scale marks indicating distances or second scale marks indicating distances and formed by enlarging the first scale marks on a display screen; and performing, by the processing section, processing on the object, having been transported by the transport section, to allow a processed product to be obtained, wherein the allowing, by the transport controller, the transport section to transport the object includes allowing the object to be transported by a first transport distance in a first case where the pointing instrument moves in a first direction by a first distance and the first scale marks are displayed on the display screen, and allows the object to be transported by a second transport distance, which is shorter than the first transport distance, in a second case where the pointing instrument moves in the first direction by the first distance and the second scale marks are displayed on the display screen, when positions of the object and the pointing instrument before the pointing instrument moves are the same for the first case and the second case, wherein the second case is a state in which a drag velocity during the first case is lower than a predetermined velocity for a period of time longer than or equal to a predetermined period of time.

17. A non-transitory computer-readable medium encoded with a transport control program for a transport device including a transport section including a motor and at least one roller configured to be rotated by the motor to transport an object, a processing section configured to perform processing on the object, and a detector configured to detect a movement of a pointing instrument on a detection surface of the detector itself, the transport control program configured to display first scale marks indicating distances or second scale marks indicating distances and formed by enlarging the first scale marks on a display screen; and allow the transport device to realize a transport control function of allowing the object to be transported by a transport distance corresponding to the movement of the pointing instrument, and in a direction corresponding to the movement of the pointing instrument, the transport distance being variable according to a movement distance of the pointing instrument, wherein the allowing of the object to be transported includes allowing the object to be transported by a first transport distance in a first case where the pointing instrument moves in a first direction by a first distance and the first scale marks are displayed on the display screen, and allows the object to be transported by a second transport distance, which is shorter than the first transport distance, in a second case where the pointing instrument moves in the first direction by the first distance and the second scale marks are displayed on the display screen, when positions of the object and the pointing instrument before the pointing instrument moves are the same for the first case and the second case, wherein the second case is a state in which a drag velocity during the first case is lower than a predetermined velocity for a period of time longer than or equal to a predetermined period of time.

* * * * *